United States Patent [19]

Stanishevsky et al.

[11] Patent Number: 5,028,304

[45] Date of Patent: Jul. 2, 1991

[54] METHOD OF ELECTROCHEMICAL MACHINING OF ARTICLES MADE OF CONDUCTING MATERIALS

[76] Inventors: Vladimir K. Stanishevsky, ulitsa Zakharova, 23, kv. 16; Alexandr E. Parshuto, Leninsky prospekt, 131, korpus 2, kv. 9; Alexandr A. Kosobutsky, ulitsa Rozy Ljuxemburg, 161, kv. 5; Leonid M. Semenenko, ulitsa Pulikhova, 7, korpus 2, kv. 5; Vladimir N. Tikhonovsky, prospekt imeni gazety "Pravda", 22, kv. 92; Vsevolod A. Khlebtsevich, ulitsa Ya.Mavra, 44, kv. 53; Leonid S. Velichko, ulitsa Korolya, 6, kv. 31; Alexei A. Semchenko, Leninsky prospekt, 42, kv. 8; Grigory E. Slepnev, ulitsa L.Bedy, 5, kv. 54, all of Minsk, U.S.S.R.

[21] Appl. No.: 499,467

[22] PCT Filed: Oct. 21, 1988

[86] PCT No.: PCT/SU88/00201

§ 371 Date: Jun. 15, 1990

§ 102(e) Date: Jun. 15, 1990

[87] PCT Pub. No.: WO90/04664

PCT Pub. Date: May 3, 1990

[51] Int. Cl.[5] ..... B23H 3/08; C25F 3/16; C25F 5/00

[52] U.S. Cl. ..... 204/129.75; 204/129.95; 204/141.5; 204/146

[58] Field of Search ..... 204/129.75, 129.95, 204/141.5, 146

[56] References Cited

U.S. PATENT DOCUMENTS

| | | | |
|---|---|---|---|
| 2,476,965 | 7/1949 | Emerson et al. | 204/129.75 X |
| 3,287,238 | 11/1966 | Latawiec et al. | 204/141.5 X |
| 3,401,103 | 9/1968 | Joyce et al. | 204/129.75 |
| 3,649,491 | 3/1972 | Bowers et al. | 204/146 |
| 3,669,858 | 6/1972 | LaBoda | 204/129.75 X |
| 3,730,856 | 5/1973 | Hines et al. | 204/141.5 |
| 4,040,920 | 8/1977 | Takada et al. | 204/129.75 |
| 4,525,249 | 6/1985 | Arora | 204/129.75 |
| 4,647,352 | 3/1987 | Cook | 204/146 |

FOREIGN PATENT DOCUMENTS 177732 8/1966 U.S.S.R. .

*Primary Examiner*—Donald R. Valentine
*Attorney, Agent, or Firm*—Lilling and Lilling

[57] ABSTRACT

The method resides in applying to a machined article a positive electric potential from 200 to 400 V and submerging the article into an aqueous electrolyte solution of a concentration from 2 to 12% by weight, at a temperature from 40° to 95° C.

10 Claims, 1 Drawing Sheet

METHOD OF ELECTROCHEMICAL MACHINING OF ARTICLES MADE OF CONDUCTING MATERIALS

FIELD OF THE INVENTION

The present invention relates to methods of electrochemical and electrophysical machining, and more particularly it relates to methods of electrochemical machining of articles made of electrically conducting materials.

BACKGROUND OF THE INVENTION

There is known a method of electrolytic anodic polishing of steel articles by direct current in a chromium-phosphorus-sulfuric acid electrolyte (A.M. Yampolski "Travleniye metallov", 1980, Metallurgiya/Moscow/, p. 51) performed by submerging articles in the electrolyte containing, % by weight:

| | |
|---|---|
| orthophosphoric acid | 65–85 |
| chromic anhydride | 6–12 |
| sulfuric acid | 5–15 |

the voltage being 10 to 25 V, and the temperature being 30°–70° C. The electrolytic polishing is conducted with the anodic current density of 50–60 A/dm$^2$ for 3–15 mn.

There is also known a method of electrolytic polishing of articles made of copper and its alloys by way of electrolysis in an aqueous solution of phosphoric acid (the density of the solution being $\rho=1.6$ g/cm$^3$) (A.M. Yampolski "Travleniye metallov", 1980, Metallurgiya (Moscow/, p. 99), or else in an electrolyte containing 385 g of potassium pyrophosphate and 853 g of water, at 20°–50° C. for 1.5–3 mn (SU, A, 177732).

There is still further known a method of electrolytic polishing of articles made of aluminium and its alloys, in an electrolyte containing 20–25% by weight of sulfuric acid, at 18°–20° C. and under a voltage of 6–12 V (Witt C., "Galvanotechnik", 1981, V.72, No. 10, pp.1073–1075).

The abovementioned methods are based on the use of high-concentration solutions of expensive and toxic substances; they are characterized by relatively long duration of the polishing operation and require prolonged pretreatment of the surface of an article prior to the electrolytic polishing operation, including degreasing, etching (pickling), flushing, etc., which adversely affects the overall productivity and efficiency, to say nothing of the considerable input of power and labour.

There is also known a method of electrochemical machining of articles made of electrically conducting materials, including treating the articles at 220–380 V in an electrolyte containing 20% aqueous solution of ammonium chloride at 35° C. (V. N. Duradzhi et al. "Elektronnaya obrabotka materialov"/Electronic Machining of Materials/, 1978, No. 5, pp.13–17).

However, this last-mentioned process fails to produce a surface finish of the articles finer than $R_a=0.28 \ldots 0.32$ μm, with the reflection factor of the machined surface within 30–40%. Furthermore, the process requires the use of an electrolyte of a relatively high concentration (20%), which increases the machining cost.

SUMMARY OF THE INVENTION

It is an object of the present invention to solve the problem of creating a method of electrochemical machining of articles of conducting materials, wherein the selection of the machining duties and concentrations of the electrolyte should step up the productivity of the machining operation and enhance the quality of polishing, with low-concentration, inexpensive and non-toxic electrolytes employed and operations of pretreatment of the surfaces of articles avoided.

The problem is solved by a method of electrochemical machining of articles of conducting materials, including applying to a machined article a positive electric potential and submerging the article in a heated aqueous electrolyte solution. In the method, in accordance with the present invention, the potential applied to the article equals 200–400 V, with the temperature of the electrolyte which is an aqueous solution of a concentration of 2–12% by weight being 40°–95° C.

To enhance still further the quality of polishing by upgrading the surface finish and raising the reflectivity of articles made of corrosion-proof chromium-nickel steel grades, it is expedient that the electric potential applied to the articles should be 240–320 V, the aqueous electrolyte solution being an aqueous solution of ammonium sulfate in a concentration of 2–6% by weight, at a temperature of 40°–80° C.

In electrolytic polishing of composite articles including chromium-nickel steel grades, it is expedient that the electric potential supplied to the article should be 330–380 V, the aqueous electrolyte solution being an aqueous solution of potassium sulfate in a concentration of 1–10% by weight, at a temperature of 70°–90° C.

In removal of enamel coatings from wires, it is essential that the electric potential applied to the article should be 200–210 V, the aqueous electrolyte solution being an aqueous solution of sodium hydroxide in a concentration of 8–12% by weight, at a temperature of 40°–50° C.

In polishing articles made of non-ferrous metals, e.g. copper and its alloys, it is preferable that the electric potential applied to the article should be 220–400 V, the aqueous electrolyte solution being an aqueous solution of aluminium potassium sulfate in a concentration of 0.5–8% by weight, at a temperature of 40°–90° C.

To reduce still further the concentration of the electrolyte, it is possible to apply to the article being machined an electric potential of 220–400 V, the aqueous electrolyte solution being an aqueous solution of disubstituted ammonium citrate in a concentration of 0.5–6% by weight with an addition of 0.5–3% by weight of sodium carbonate, at a temperature of 40°–90° C.

It is reasonable to apply to the article being machined an electric potential of 220–400 V, the aqueous electrolyte solution being an aqueous solution of sodium ethylenediamine tetraacetate in a concentration of 0.5–6% by weight, at a temperature of 40°–90° C.

In electrolytic polishing of articles made of low-carbon steels, it is expedient that the electric potential applied to the article being machined should be 240–380 V, the aqueous electrolyte solution being an aqueous solution of ammonium chloride in a 0.5–8% by weight concentration, at a temperature of 81°–95° C.

To prolong the operational life of the electrolyte, it is reasonable that the electrolyte should additionally contain ammonium thiocyanite in a 0.3–3% by weight concentration.

Furthermore, to enhance the reflectivity of the machined surface and improve its surface finish in electrolytic polishing of aluminium articles, it is expedient that the electric potential applied to the machined article should be 260–400 V, the aqueous electrolyte solution being an aqueous solution of ferric chloride in a concentration of 0.5–3% by weight, at a temperature of 70°–90° C.

The invention employs the disclosed process of electrochemical machining of articles of conducting materials for polishing and cleaning articles of stainless, tool and low-carbon steels, of copper and its alloys, of aluminium and other materials, by combining in one and the same process the cleaning and polishing operations, with full adaptability of the process to mechanization and automation in any production technology at high ecological standards owing to the electrolytes used being harmless and low-toxic. The machining of articles offers fine surface finish and brightening of their surfaces, deburring, adequate preparation to subsequent application of diverse coatings, removal of practically all kinds of pollutants, such as preservants, rust, scale, paint and varnish coats.

BRIEF DESCRIPTION OF DRAWINGS

The invention will be further described in connection with examples of its implementation, with reference being made to the accompanying drawings, wherein.

BEST MODE FOR CARRYING OUT THE INVENTION

Figure 1:
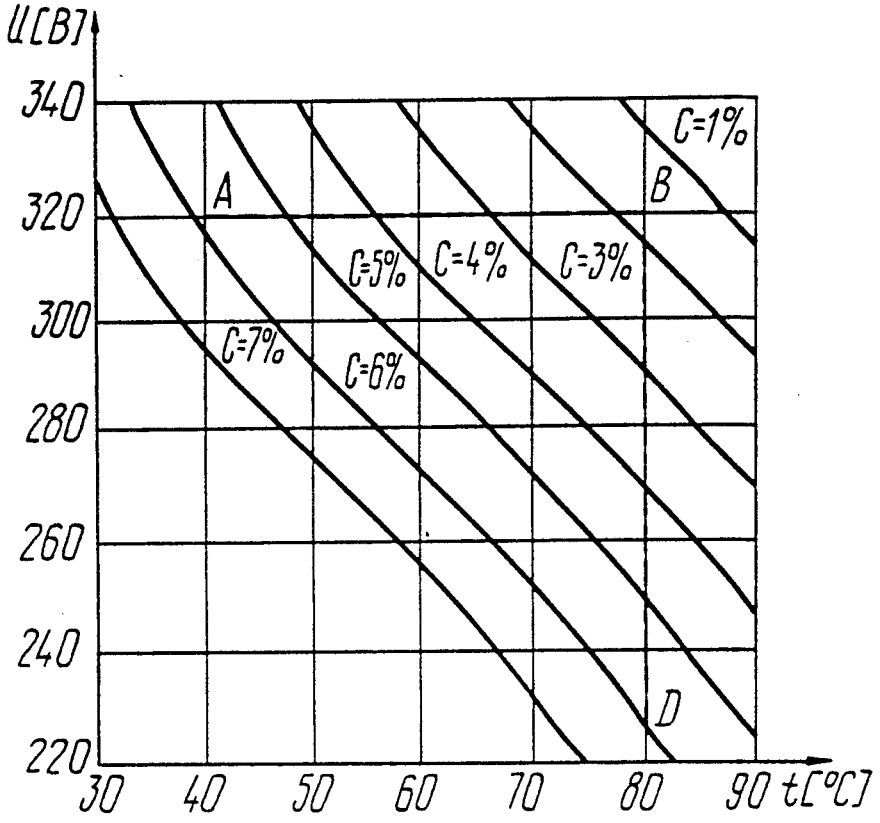
FIG. 1 is a paragraph showing the relationships between the value of the electric potential applied to the machined article and the temperature of the electrolyte being an aqueous solution of different concentrations, in accordance with the invention.

The disclosed method of electrochemical machining of articles of conducting materials resides in applying to the article being machined a positive electric potential of 200–400 V and submerging the article in an electrolyte in the form of an aqueous solution of a 2–12% by weight concentration, at a temperature of 40°–95° C.

This method of electrochemical machining of articles of conducting materials is characterized by maintaining at the surface of an article a stable vapour/gas envelope separating the surface from the electrolyte and promoting intense chemical and electrochemical reactions between the material of the article—the anode—and the electrolyte vapours. This brings about anodic oxidation of the surface of the metal of the article, with simultaneous chemical etching of the oxide thus produced. When the rates of oxidation and etching are balanced, the effect of polishing takes place, enhancing the reflectivity of the surface and improving its finish (i.e. reducing its roughness). The maximum reflectivity is attained at the minimum thickness of the oxide layer capable of inhibiting the etching action of the electrolyte vapours, with the etching taking place prevailingly at microirregularities where the oxide layer formed is the thinnest. Moreover, the stepped-up intensity of the electric field across the article—vapour/gas envelope—electrolyte gap results in a situation where any existing apexes of the microrelief of the article surface become actively rounded off, thereby reducing the roughness of the surface.

Thus, the reflectivity and surface finish of the machined surface of an article are dependent on the value of the electric potential (voltage) applied, the concentration and chemical composition of the electrolyte.

The disclosed method will be illustrated by examples of its implementation.

EXAMPLE 1

The articles machined are flat $20\times30\times2$ mm$^3$ workpieces of corrosion-proof steel containing 0.1% C, 18% Cr, 10% Ni, 1% Ti, Fe—the balance. The time of machining is 2 mn. The initial surface roughness is $R_a=0.65$–0.68 m, and the initial reflectivity $\gamma$ is 35–38% (with respect to a silver mirror).

The machining duties of the workpieces have been selected within the following ranges: working voltage, 240–320 V; electrolyte temperature, 40°–80° C.; electrolyte composition, 2–6% by weight aqueous solution of ammonium sulfate. The choice of the upper limits of the above ranges has been suggested by the following considerations.

The use of more concentrated solutions of ammonium sulfate results in evident impairment of the machining quality. The threshold concentration value of the solution still yielding the polishing effect is 6–7% by weight. With a higher concentration, the etching of the metal prevails, eliminating the bringhtness (gloss) of the machined surface. The heating of an electrolyte with a 2–6% concentration of ammonium sulfate to temperatures in excess of 80°–85° C. likewise affects adversely the machining quality by causing pinholes resulting from the elevated chemical activity of the electrolyte at such temperatures. With the voltage (potential) raised higher than 320–330 V, the roughness of the machined surface is increased on account of microcaverns caused by electric breakdowns through the electrode/article-electrolyte gap. Furthermore, an increased voltage steps up the power input. Thus, the polishing process is limited by the upper thresholds of the machining duty: voltage (potential), 320 V; electrolyte temperature, 80° C.; electrolyte concentration, 6% by weight.

The choice of the lower limits of the above ranges of the process duty has been dictated by the experimentally obtained averaged plots of relationships between the voltage (potential) value U (FIG. 1) and the temperature t of the electrolyte of different concentrations C. The regions of a stable vapour/gas envelope and, hence, of the normal process in the diagram of FIG. 1 are the regions on the top and right of the line of the electrolyte concentration C. Should the working point be chosen from a region to the left down from the curve corresponding to a given concentration C, breakoff of the envelope would take place, resulting in an on-off switching duty of the electrolytic process, i.e. intermittent direct contacts of the electrolyte with the surface of the article. In the areas of such contact, conventional electrochemical erosion of the metal takes place, causing a sharp drop of the reflectivity and increased surface roughness. Moreover, as the value of the electric current thus consumed is significantly above the value associated with a stable process, the power input sharply rises, impairing the economic ratings of the machining process. Thus, the on-off switching duty of electrolytic polishing must be avoided by all means.

Accounting for the previously mentioned upper thresholds of the electrolytic polishing duty, the working area in the diagram of FIG. 1 is the zone limited by stretches AB (voltage U), BD (electrolyte temperature "t"). and DA (electrolyte concentration C). It can be seen from the diagram that a reduction of the concentration C of the electrolyte leads to the rising of the minimum values of the voltage U and electrolyte temperature "t" supporting a stable process. With the electrolyte concentration C equalling 2%, the temperature t and voltage U approach the threshold values, which renders the use of low concentrations C of the electrolyte ill-advisable. Table 1 below sums up the outcome of the machining of articles.

Figure 2:
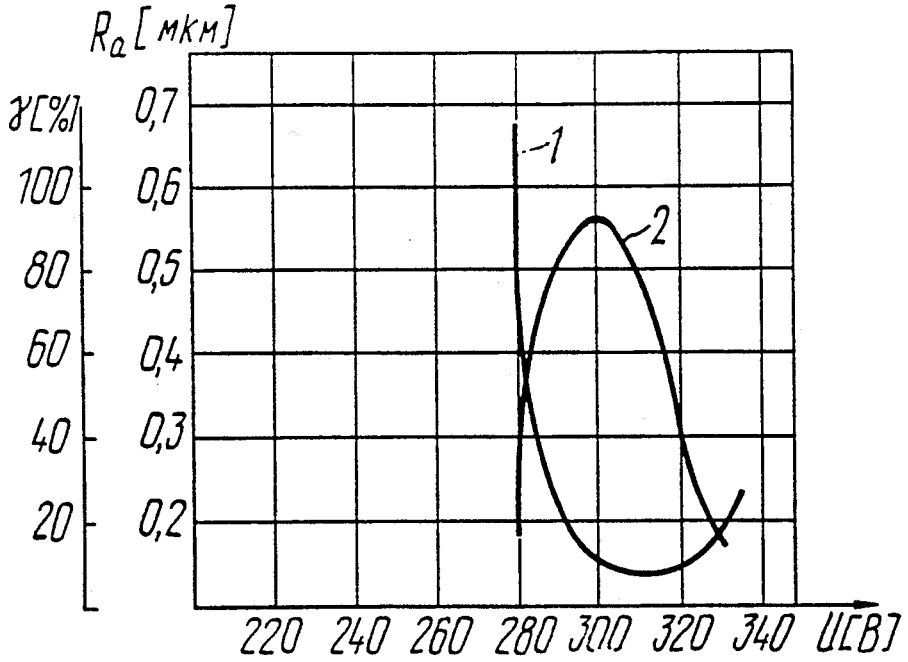
FIG. 2 is a paragraph, showing the dependence of the surface finish and reflectivity of the surface of an article after machining on the potential applied to the machined article, in accordance with the invention.

The plots of dependence of the roughness (surface finish $R_a$ and reflectivity $\gamma$ on the applied voltage (potential) are given in FIG. 2 where Curve 1 shows the variation of the surface roughness $R_a$ and Curve 2 shows the variation of the reflectivity $\gamma$ in machining of articles in accordance with the disclosed method, Example 1. It can be seen from the diagram in FIG. 2 that the extremum is attained within the range of voltage values from 300 to 320 V, with the value of surface roughness $R_a$ being 0.16–0.12 μm (Curve 1). The second essential characteristic—reflectivity $\gamma$—can be seen following a similar pattern, attaining 93–95% in a duty suggested by the disclosed method, which is confirmed by the very nature of Curve 2.

EXAMPLE 2

Composite metal articles are treated, e.g. blanks for dentures made of corrosion-resistant steel grades. The press-formed parts of a denture are made of steel containing 0.12 C, 18% Cr, 9% Ni, 1% Ti, Fe—the balance, while the intermediate cast parts are made of steel containing 0.2% C, 18% Cr, 9% Ni, 2% Si, Fe—the balance.

The workpieces have the initial surface roughness $R_a$=0.7 . . . 0.73 μm and reflectivity 36–38% (with respect to a silver mirror). The time of machining is 2 mn. The working duty of the machining of the composite metal articles has been selected within the following ranges: voltage (potential) applied to the machined articles, 330–380 V; electrolyte temperature, 70°–90° C.; electrolyte composition, 1–10% aqueous solution of potassium sulfate.

A conventional technology of polishing composite articles presupposes their wither mechanical or electrolytic machining with different duties for their different components, e.g. different values of the voltage and temperature and different electrolyte compositions in electrolytic machining, depending on the steel grades combined in the structure of an article. The proposed technology allows to conduct the machining of a composite (bimetallic) article in a single process enhancing the reflectivity of the machined surfaces.

The use of an electrolyte in the form of an aqueous solution of potassium sulfate allows to attain the effect of mirror-polishing of articles of chromium-nickel-silicon steel. The choice of the working voltage within 330–380 V is explained by the fact that with the voltage lowered to 300–315 V, the stability of the gas/vapour envelope declines, breakoffs of the envelope take place, and the process attains an on-off switching duty with sharp leaps of the current value. This impairs the machining quality and significantly increases the power input. With the voltage raised to 385–400 V, the reflectivity $\gamma$ and surface finish $R_a$ are impaired by the metal surface developing traces of electric breakdowns through the electrode/article-electrolyte gap.

With the electrolyte concentration reduced below 1%, the throughput of the machining operation is impaired, and a higher voltage has to be applied to compensate for lower electric conductivity of the solution. With the concentration raised above 10%, the etching of the metal prevails, sharply impairing the reflectivity.

The electrolyte temperature range within which the machining process of this example yields the optimized parameters is 70°–90° C. With a temperature below 70° C., the stability of the gas/vapour envelope is impaired, and the process is accompanied by considerable fluctuations of the current and voltage values; with a temperature above 90° C., the machining quality is impaired by the elevated chemical activity of the electrolyte and affected thermal balance of the article—gas/vapour envelope-electrolyte system.

TABLE 1

Duties and Results of Machining of Articles Made of Steel Containing 0.1 % C, 18 % Cr, 9 % Ni, 1 % Ti

| | Electrolyte concentration C, % | | | | | | | | | | |
|---|---|---|---|---|---|---|---|---|---|---|---|
| | 1 | | | 2 | | | 4 | | | | |
| | 1 | 2 | 3 | 4 | 5 | 6 | 7 | 8 | 9 | 10 | 11 |
| Duty | | | | | | | | | | | |
| U, V | 340 | 330 | 320 | 330 | 320 | 310 | 330 | 310 | 300 | 290 | 270 |
| t, °C. | 80 | 85 | 90 | 75 | 80 | 85 | 60 | 65 | 70 | 80 | 85 |
| i, A/cm² | 0.22 | 0.2 | 0.18 | 0.25 | 0.22 | 0.21 | 0.27 | 0.24 | 0.22 | 0.21 | 0.2 |
| Parameter | | | | | | | | | | | |
| $R_a$, μm | 0.52 | 1.06 | 1.46 | 0.22 | 0.34 | 0.42 | 0.18 | 0.14 | 0.1 | 0.24 | 0.86 |
| γ, % | 35 | 34 | 33 | 44 | 42 | 39 | 53 | 65 | 92 | 47 | 41 |

| | 6 | | | | | 7 | | |
|---|---|---|---|---|---|---|---|---|
| | 12 | 13 | 14 | 15 | 16 | 17 | 18 | 19 |
| Duty | | | | | | | | |
| U, V | 330 | 310 | 290 | 250 | 230 | 330 | 270 | 220 |
| t, °C. | 40 | 50 | 65 | 75 | 85 | 45 | 60 | 80 |
| i, A/cm² | 0.28 | 0.24 | 0.22 | 0.2 | 0.18 | 0.3 | 0.27 | 0.21 |
| Parameter | | | | | | | | |
| $R_a$, μm | 0.22 | 0.18 | 0.12 | 0.08 | 0.36 | 0.18 | 0.2 | 0.25 |
| γ, % | 45 | 65 | 77 | 95 | 56 | 37 | 39 | 36 |

Note.
U - potential applied to the article
t - electrolyte temperature
i - current density
$R_a$ - roughness of machined surface
γ - reflectivity of machined surface The results of the machining are summed up in Table 2. It can be seen from Table 2 that the process of Example 2 provides for attaining the minimum value of surface roughness of the surface of the article parts made of the two steel grades $R_a=0.08 \ldots 0.09$ μm, with reflectivity $\gamma=93 \ldots 95\%$.

TABLE 2

Duties and Results of Machining of Denture Blanks by Disclosed Method

| | Concentration, by weight | | | | | | | |
|---|---|---|---|---|---|---|---|---|
| | 0.8 | | | | 1 | | | |
| | 1 | 2 | 3 | 4 | 5 | 6 | 7 | 8 |
| Voltage U, V | 390 | 360 | 330 | 310 | 390 | 360 | 330 | 310 |
| Reflectivity γ, % | 35 | 36 | 35.6 | 36 | 36 | 36 | 36 | 36 |
| Surface roughness $R_a$, μm | 0.21 | 0.22 | 0.3 | 0.33 | 0.18 | 0.16 | 0.24 | 0.27 |
| Reflectivity γ, % | 35 | 36 | 35 | 35 | 36 | 36 | 36 | 36 |
| Surface roughness $R_a$, μm | 0.23 | 0.25 | 0.34 | 0.35 | 0.19 | 0.17 | 0.25 | 0.29 |
| | 3 | | | | 5 | | | |
| | 9 | 10 | 11 | 12 | 13 | 14 | 15 | 16 |
| Voltage U, V | 390 | 360 | 330 | 310 | 390 | 360 | 330 | 310 |
| Reflectivity γ, % | 54 | 69 | 63 | 49 | 65 | 91 | 81 | 69 |
| Surface roughness $R_a$, μm | 0.15 | 0.11 | 0.15 | 0.17 | 0.13 | 0.09 | 0.08 | 0.1 |
| Reflectivity γ, % | 53 | 67 | 61 | 49 | 67 | 93 | 79 | 67 |
| Surface roughness $R_a$, μm | 0.15 | 0.12 | 0.17 | 0.16 | 0.14 | 0.1 | 0.09 | 0.1 |
| | 7 | | | | 10 | | | |
| | 17 | 18 | 19 | 20 | 21 | 22 | 23 | 24 |
| Voltage U, V | 390 | 360 | 330 | 310 | 390 | 360 | 330 | 310 |
| Reflectivity γ, % | 57 | 79 | 85 | 61 | 36 | 39 | 41 | 36 |
| Surface roughness $R_a$, μm | 0.13 | 0.1 | 0.1 | 0.12 | 0.12 | 0.28 | 0.22 | 0.23 |
| Reflectivity γ, % | 61 | 79 | 75 | 63 | 36 | 39 | 43 | 36 |
| Surface roughness $R_a$, μm | 0.14 | 0.11 | 0.1 | 0.13 | 0.27 | 0.26 | 0.21 | 0.23 |
| | 11 | | | | | | | |
| | 25 | | 26 | | 27 | | 28 | |
| Voltage U, V | 390 | | 360 | | 330 | | 310 | |
| Reflectivity γ, % | 35 | | 36 | | 35 | | 35 | |
| Surface roughness $R_a$, μm | 0.47 | | 0.45 | | 0.41 | | 0.43 | |
| Reflectivity γ, % | 35 | | 36 | | 35 | | 36 | |
| Surface roughness $R_a$, μm | 0.46 | | 0.44 | | 0.39 | | 0.4 | |

EXAMPLE 3

Copper winding wire 0.4 μm and 1 μm in diameter, insulated with lacquers based on polyesters and polyvinylacetate enamels are machined to remove the insulating layer and scrape bright the wire surface. The machining duty is within the following ranges: voltage, 200–210 V; electrolyte temperature, 40°–50° C.; electrolyte, 8–12% aqueous solution of sodium hydroxide.

In this example the disclosed method is based on implementation of an electro-hydrodynamic process of electrolytis machining.

The process is characterized by the absence of specific heating of an article to elevated temperatures, which would have impeded the subsequent soldering of the copper wire and required additional operations of scraping off the oxides, had they been surrounded by a stable gas/vapour envelope. Owing to the high intensity of the electric field and an elevated temperature, the envelope has a chemically active medium intensely interacting with the surface of the machined article. The joint action of the chemically active medium of the gas/vapour envelope and of the elevated temperature locally developed in the places of its electric breakdown burns away the enamel-lacquer insulation, cleaning simultaneously the wire surface from remaining traces of the coating.

The process is conducted, as follows.

A wire with its enamel-lacquer insulation is dipped into the solution to a depth equalling the length of the end portion of the wire to be stripped.

A positive electric potential of 200–210 V is applied to the wire above its dipped portion, whereby a gas/vapour envelope develops at the bare cut and face of the wire. The elevated temperature developing in the channels of electric discharges penetrating the envelope burns away the insulation on the surface of the wire. As the area of the surface with the charged insulation becomes conducting, a gas/vapour envelope develops at this area, too, removing the remaining insulation and stripping the surface to a practically clean state. The most active destruction of the enamel-lacquer coat takes place at the interface between the already cleaned surface of the wire and the surface still coated with the insulation. This zone of active removal ascends to the surface level of the solution.

The choice of the working voltage (potential) within the 200–210 V range is due to the fact that with the voltage lowered to 188–195 V, the stability of the developing gas/vapour envelope is impaired. This causes an unstable working duty and sharply reduced efficiency of the process. However, with the voltage raised to 220–230 V or higher, the thickness of the gas/vapour envelope increases, and the efficiency is impaired by a decline of the pulsed current through the gas/vapour envelope.

The employment of the chemically active NaOH solution in water as the electrolyte is explained by its high electric conductivity, avoidance of excessive heating of the anode wire at 200–210 V, the high chemical activity with respect to the remaining coating and the alkaline nature of the solution preventing corrosion of the wire after the stripping. With the concentration lowered below 8%, the efficiency is affected by inadequate chemical activity of the solution. Raising the concentration above 12% leads to an increased input of NaOH and active splashing of the solution in the process of cleaning, impairing the working environment and yielding no visible gain in the productivity. The temperature range of 40°-50° C. is explained by the fact that with the temperature below 40° C., there takes place breaking off of the gas/vapour envelope and development of an on-off switching duty, whereas with the temperature above 50° C., the thickness of the gas/-vapour envelope grows, and the efficiency of the stripping process is impaired.

The minimum cleaning time of the abovedescribed wires by the disclosed method is: 0.4 μm diameter wire, 8 s; 1 μm diameter wire, 28 s; 0.4 μm diameter wire, 16 s (in a modified duty); 1 m diameter wire, 36 s.

Thus, the proposed process of stripping enamel-lacquer insulation from copper winding wire provides for stepping up the productivity of the treatment twofold to fourfold, while eliminating manual labour, avoiding the use of costly and toxic chemicals and improving the working environment.

EXAMPLE 4

Flat 20×30×1 $mm^3$ plates are processed, made of an alloy containing 62% copper and 38% zinc, and also of pure copper. The time of machining is 60 s. The initial surface roughness is $R_a$=0.55 . . . 0.6 μm, and the reflectivity with respect to a silver mirror is 32-35%. The machining duty is selected within the following ranges: working voltage, 220-400 V; electrolyte temperature, 40°-90° C.; electrolyte composition, 0.5-8% by weight aqueous solution of aluminium potassium sulfate (or 0.5-6% by weight disubstituted ammonium citrate +0.5-3% $Na_2CO_3$; or 0.5-6% by weight sodium ethylenediamine tetraacetate).

The choice of the lower voltage threshold is explained by the fact that with voltages below 220 V there takes place breaking off of the gas/vapour envelope formed about the article, whereas the presence of this envelope is an essential condition of polishing in the electrodynamic mode. In such cases the machining process is accompanied by a considerable rise of the consumed current and impaired polishing effect, as bad as complete absence of polishing, with dark stains (a film) appearing on the article surface. On the other hand, if the voltage is raised above 400 V, the polishing gloss is impaired by pinholes appearing on the article surface, caused by electric breakdowns through the article-electrolyte gap.

With the concentration of the above solutions lowered below 0.5%, it becomes impossible to maintain a stable electrodynamic process throughout the above-stated range of working voltages from 220 to 400 V, so that the productivity of the machining operation is adversely affected. With the abovespecified upper concentration limits exceeded, however, the etching process prevails, impairing the polishing quality.

With the electrolyte temperature below 40° C., impaired stability of the gas/vapour envelope is observed, threatening interruption of the machining process. With the electrolyte temperature raised above 90° C., the machining quality is impaired on account of increased chemical activity of the electrolyte and intense evaporation of water causing the changing concentration of the solution.

The abovedescribed machining duties have yielded the surface roughness (finish) of $R_a$=0.05 μm and reflectivity with respect to a silver mirror γ=95 . . . 97%.

Thus, machining by the disclosed method allows to attain fine quality of polishing, while reducing the machining time to one third and the concentration 8-10 times.

EXAMPLE 5

Flat 30×20×10 $mm^3$ articles of low-carbon steel (carbon content 0.08%) are machined for 3 mn. The initial surface roughness is $R_a$=1.2 μm, and reflectivity γ=33-35% with respect to a silver mirror.

The machining duty is selected within the following ranges: working voltage (potential), 240-380 V; electrolyte temperature, 81°-95° C.; electrolyte composition, 0.5-8% aqueous solution of ammonium chloride. The choice of the threshold values of these ranges is explained, as follows.

Tests have indicated that with the voltage raised above 380-390 V the final surface roughness $R_a$ is increased on account of heightened electric erosion caused by electric breakdowns through the article-electrolyte gap. With the voltage below 230-240 V, the stability of the gas/vapour envelope about the article is impaired, and the process itself becomes unstable, with big leaps of the current value. This causes a sharp increase of power consumption, while adversely affecting the final reflectivity γ and increasing the surface roughness $R_a$ of the machined article. With the electrolyte temperature below 75°-80° C., the process stability is impaired and would not be restored by stepping up the voltage to a 380°-390° C. level.

With the electrolyte temperature above 95° C. the machining quality is impaired on account of increased chemical activity of the electrolyte.

The outcome of the machining operation is summed up in Table 3.

TABLE 3

Duties and Parameters of Machining Low-Carbon Steel (C = 0.8 %) Articles in Ammonium Chloride Solution

| | | | | | | | | | |
|---|---|---|---|---|---|---|---|---|---|
| Electrolyte parameters | Concentration, % by weight | 0.3 | | | | 0.5 | | | |
| | Density at 20° C., g/$cm^3$ | 1.001 | | | | 1.001 | | | |
| Machining duty | Voltage, V | 390 | 320 | 260 | 230 | 390 | 320 | 260 | 230 |
| | Temperature, °C. | 82 | 82 | 84 | 85 | 82 | 85 | 85 | 85 |
| Quality parameters | Reflectivity γ, % | 34 | 36 | 35 | 34 | 37 | 41 | 38 | 35 |
| | Surface roughness $R_a$, μm | 1.03 | 1.22 | 1.14 | 1.13 | 1.12 | 1.06 | 1.1 | 1.13 |
| Electrolyte | Concentration, | 3 | | | | 5 | | | |

TABLE 3-continued

| Duties and Parameters of Machining Low-Carbon Steel (C = 0.8 %) Articles in Ammonium Chloride Solution | | | | | | | | | |
|---|---|---|---|---|---|---|---|---|---|
| parameters | % by weight | | | | | | | | |
| | Density at 20° C., g/cm³ | 1.008 | | | | 1.014 | | | |
| Machining duty | Voltage, V | 390 | 320 | 260 | 230 | 390 | 320 | 260 | 230 |
| | Temperature, °C. | 84 | 85 | 83 | 83 | 84 | 82 | 82 | 85 |
| Quality parameters | Reflectivity γ, % | 49 | 87 | 83 | 61 | 47 | 77 | 67 | 53 |
| | Surface roughness $R_a$, μm | 10.29 | 0.23 | 0.21 | 0.31 | 0.68 | 0.42 | 0.4 | 0.51 |
| Electrolyte parameters | Concentration, % by weight | 8 | | | | 8.5 | | | |
| | Density at 20° C., g/cm³ | 1.018 | | | | 1.019 | | | |
| Machining duty | Voltage, V | 390 | 320 | 260 | 230 | 390 | 320 | 260 | 230 |
| | Temperature, °C. | 85 | 83 | 83 | 85 | 82 | 82 | 85 | 85 |
| Quality parameters | Reflectivity γ, % | 35 | 37 | 43 | 35 | 34 | 34 | 35 | 34 |
| | Surface roughness $R_a$, μm | 1.2 | 1.17 | 1.12 | 1.15 | 1.52 | 1.37 | 1.32 | 1.25 |

EXAMPLE 6

To prolong the operational life of the electrolyte containing aqueous solution pf ammonium chloride, ammonium thiocyanate is added to the electrolyte in a 0.5-3% by weight concentration. Tests have shown that in this way the serviceability of the electrolyte is prolonged by 50-100%. Comparative tests have been conducted to determine the operational life of the electrolyte. An article lot of 50 pieces with the total treatment time of 150 mn displayed stable indicators of the final surface roughness (finish) $R_a$ value. With the number of articles machined in one and the same electrolyte increased from 50 to 100 pieces, the surface roughness (finish) indicator $R_a$ was adversely affected.

Thus, with the electrolyte containing 3% by weight $NH_4Cl$ and the voltage being 320-260-240 V, the final surface roughness of the last articles of the 100-piece lot was increased, respectively, to 0.25-0.23-0.32 μm. With 1.5% $NH_4CNS$ added to the same electrolyte, the increased final surface roughness was observed only when the lot of machined articles exceeded 100 pieces. Thus, it has been found that the introduction of the additive into the electrolyte prolongs its serviceability up to twofold, with no impairment of the final reflectivity γ and surface finish $R_a$ of machined articles. Table 4 sums up the outcome of the tests conducted with the two-component electrolyte containing the ammonium thiocyanate ($NH_4CHS$) additive. With the additive introduced in concentrations below 0.5% by weight, it has practically no effect of the serviceability of the electrolyte, whereas when the additive concentration exceeds 3%, a black film appears on the surface of articles. With other ratios of $NH_4Cl$ and $NH_4CNS$ within the specified ranges, the tests have shown similar results: the reflectivity γ and surface finish $R_a$ of machined articles are unaffected, while the serviceability period of the electrolyte is prolonged by 50 to 100%.

TABLE 4

| Prolonged Serviceability of Electrolyte with Ammonium Thiocyanate Added | | | | | | |
|---|---|---|---|---|---|---|
| Electrolyte composition | Machining parameters | Number of machined articles | | | | |
| | | 50 | 75 | 100 | 125 | 150 |
| $NH_4Cl$ - 3 % | $R_a$, μm | 0.25 | 0.32 | 0.41 | 0.6 | 0.85 |
| | γ, % | 90 | 69 | 61 | 57 | 53 |
| $NH_4Cl$ - 3 % | $R_a$, μm | 0.24 | 0.25 | 0.26 | 0.39 | 0.39 |
| $NH_4CNS$ - 1 % | γ, % | 90.5 | 90 | 89 | 69 | 65 |

EXAMPLE 7

Flat 20×30×2 mm aluminium plates are machined for 1 minute. The initial surface roughness $R_a$=1.03 μm, and the reflectivity with respect to a silver mirror is 35%. The machining duty is selected within the following ranges: working voltage (potential), 260-400 V; electrolyte temperature, 70°-90° C.; electrolyte composition, 0.5-3% by weight ferric chloride.

The employment of ferric chloride for machining aluminium in the electro-hydrodynamic mode provides for enhancing the reflectivity γ and finish $R_a$ of the machined surface. The upper threshold of concentrations yielding the polishing effect is 3%, as higher concentrations lead to prevailing etching of the metal, with the gloss lost. With the electrolyte of a 0.5-3% concentration heated above 90° C., the machining quality is likewise impaired by appearance of pinholes caused by increased chemical activity of the electrolyte at such temperatures. At voltages above 400 V, microscopic caverns resulting from electric breakdowns through the article-electrolyte gap increase the roughness $R_a$ of the machined surface.

With the electrolyte concentrations below 0.5%, the minimum values of voltage and electrolyte temperature at which a stable process is still maintained are raised. With concentrations below 0.5% and temperatures under 60° C., the electrolytic machining process changes over to the on-off switching mode, with periodic electric contact of the electrolyte with the article surface. Heightened electrochemical anodic erosion of the metal takes place in the areas of contact, impairing the reflectivity of the machined surface and increasing its roughness $R_a$.

In the example being described, the surface roughness $R_a$ is reduced to 0.3 μm, and the reflectivity γ is raised to 73%.

INDUSTRIAL APPLICABILITY

The invention can be used in engineering technologies for finishing working of articles, and also for preparing articles for electroplating, vacuum sputtering or ion-plasma coating.

We claim:

1. A method of electrochemical machining of articles of conducting materials, including applying to a machined article a positive electric potential and submerging the article in a heated electrolyte aqueous solution, characterized in that the potential applied to the article equals 200–400 V, with the temperature of the electrolyte which is an aqueous solution of a concentration of 2–12% by weight being 40°–95° C.

2. A method of electrochemical machining of articles of conducting materials, as claimed in claim 1, characterized in that the potential applied to the machined article is within a range from 240 to 320 V, the aqueous electrolyte solution being an aqueous solution of ammonium sulfate in a concentration of 2 to 6% by weight, and the temperature of the electrolyte being 40°–80° C.

3. A method of electrochemical machining of articles of conducting materials, as claimed in claim 1, characterized in that the potential applied to the machined article is within a range from 330 to 380 V, the aqueous electrolyte solution being an aqueous solution of potassium sulfate in a concentration of 1 to 10% by weight, and the temperature of the electrolyte being 70°–90° C.

4. A method of electrochemical machining of articles of conducting materials, as claimed in claim 1, characterized in that the potential applied to the machined article is within a range from 200 to 210 V, the aqueous electrolyte solution being an aqueous solution of sodium hydroxide in a concentration of 8 to 12% by weight, and the temperature of the electrolyte being 40°–50° C.

5. A method of electrochemical machining of articles of conducting materials, as claimed in claim 1, characterized in that the potential applied to the machined article is within a range from 220 to 400 V, the aqueous electrolyte solution being an aqueous solution of aluminium potassium sulfate in a concentration of 0.5 to 8% by weight, and the temperature of the electrolyte being 40°–90° C.

6. A method of electrochemical machining of articles of conducting materials, as claimed in claim 1, characterized in that the potential applied to the machined article is within a range from 220 to 240 V, the aqueous electrolyte solution being an aqueous solution of disubstituted ammonium citrate in a concentration of 0.5 to 6% by weight with an addition of sodium carbonate in a concentration of 0.5 to 3% by weight, and the temperature of the electrolyte being 40°–90° C.

7. A method of electrochemical machining of articles of conducting materials, as claimed in claim 1, characterized in that the potential applied to the machined article is within a range from 220 to 400 V, the aqueous electrolyte solution being an aqueous solution of sodium ethylenediamine tetraacetate in a concentration of 0.5 to 6% by weight, the temperature of the electrolyte being 40°–90° C.

8. A method of electrochemical machining of articles of conducting materials, as claimed in claim 1, characterized in that the potential applied to the machined article is within a range from 240 to 380 V, the aqueous electrolyte solution being an aqueous solution of ammonium chloride in a concentration of 0.5 to 8% by weight, the temperature of the electrolyte being 81°–95° C.

9. A method of electrochemical machining of articles of conducting materials, as claimed in claim 8, characterized in that it includes adding to the aqueous electrolyte solution ammonium thiocyanate in a concentration of 0.5 to 3% by weight.

10. A method of electrochemical machining of articles of conducting materials, as claimed in claim 1, characterized in that the potential applied to the machined article is within a range from 260 to 400 V, the aqueous electrolyte solution being an aqueous solution of ferric chloride in a concentration of 0.5 to 3% by weight, the electrolyte temperature being 70°–90° C.

* * * * *